US011503403B2

(12) United States Patent
Kuwahara et al.

(10) Patent No.: US 11,503,403 B2
(45) Date of Patent: Nov. 15, 2022

(54) SOUND OUTPUT DEVICE

(71) Applicant: SONY CORPORATION, Tokyo (JP)

(72) Inventors: Eiji Kuwahara, Tokyo (JP); Takahiro Suzuki, Tokyo (JP); Daizen Kobayashi, Tokyo (JP); Mizuki Shimamura, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/250,518

(22) PCT Filed: Jun. 26, 2019

(86) PCT No.: PCT/JP2019/025359
§ 371 (c)(1),
(2) Date: Jan. 31, 2021

(87) PCT Pub. No.: WO2020/031534
PCT Pub. Date: Feb. 13, 2020

(65) Prior Publication Data

US 2021/0297771 A1 Sep. 23, 2021

(30) Foreign Application Priority Data

Aug. 7, 2018 (JP) ..... JP2018-148450

(51) Int. Cl.
*H04R 1/10* (2006.01)
*H04R 1/34* (2006.01)
*H04R 1/26* (2006.01)

(52) U.S. Cl.
CPC ..... *H04R 1/345* (2013.01); *H04R 1/1016* (2013.01); *H04R 1/26* (2013.01); *H04R 2201/34* (2013.01)

(58) Field of Classification Search
CPC ..... H04R 1/24; H04R 1/26; H04R 1/1016; H04R 1/1075; H04R 25/604; H04R 2205/022
See application file for complete search history.

(56) References Cited

U.S. PATENT DOCUMENTS 7,340,071 B2 * 3/2008 Huang ..... H04R 1/1075 381/309
8,515,103 B2 * 8/2013 Mei ..... H04R 1/1066 381/309

(Continued)

FOREIGN PATENT DOCUMENTS

JP 3188023 B2 7/2001
JP 3193406 B2 7/2001
JP 2013-026746 A 2/2013

OTHER PUBLICATIONS

International Search Report and Written Opinion of PCT Application No. PCT/JP2019/025359, dated Aug. 13, 2019, 7 pages of ISRWO.

*Primary Examiner* — Ryan Robinson
(74) *Attorney, Agent, or Firm* — Chip Law Group

(57) ABSTRACT

Sound quality is improved. A plurality of speaker units including a first speaker unit of a dynamic type, an arrangement case having an inner space formed as an arrangement space in which the plurality of speaker units is arranged, and a sound conduit protruding from the arrangement case and provided as a path for sound output from the plurality of speaker units are provided, the first speaker unit has a highest sound output band among the plurality of speaker units, the axial direction of the sound conduit and the axial direction of the first speaker unit are oriented in the same direction, the speaker units except the first speaker unit are arranged around the first speaker unit or on the opposite side to the sound conduit with the first speaker unit therebetween, (Continued)

and a central axis of the first speaker unit is positioned further on the inner side than the inner peripheral surface of the sound conduit.

12 Claims, 10 Drawing Sheets

(56) References Cited

U.S. PATENT DOCUMENTS 8,873,790 B2 * 10/2014 Hayashida ..... H04R 1/1016 381/370
9,055,366 B2 * 6/2015 Azmi ..... H04R 1/1075
9,161,128 B2 * 10/2015 Harvey ..... H04R 3/04
9,344,784 B2 * 5/2016 Wen ..... H04R 1/02
9,467,762 B2 * 10/2016 Huang ..... H04R 5/033
9,516,403 B2 * 12/2016 Huang ..... H04R 25/604
9,601,682 B2 * 3/2017 Ishii ..... H04R 17/00
9,654,881 B2 * 5/2017 Ishii ..... H04R 17/00
9,756,427 B2 * 9/2017 Doshida ..... H04R 17/00
10,149,034 B2 * 12/2018 Tsubone ..... H04R 1/2857
10,171,902 B2 * 1/2019 Ball ..... H04R 1/1075
10,477,295 B2 * 11/2019 Ouchi ..... H04R 1/24
10,721,549 B2 * 7/2020 Belonozhko ..... H04R 1/24
11,076,222 B2 * 7/2021 Irii ..... H04R 7/16
11,190,867 B2 * 11/2021 Schmidt ..... H04R 1/028
2011/0317856 A1 * 12/2011 Akasu ..... H04R 1/1091 381/109
2014/0140565 A1 * 5/2014 Liu ..... H04R 1/1091 381/380
2014/0226843 A1 * 8/2014 Pan ..... H04R 5/0335 381/309
2017/0134844 A1 * 5/2017 Liu ..... H04R 1/1016
2019/0261079 A1 * 8/2019 Okawa ..... H04R 1/1016

* cited by examiner

SOUND OUTPUT DEVICE

CROSS REFERENCE TO RELATED APPLICATIONS

This application is a U.S. National Phase of International Patent Application No. PCT/JP2019/025359 filed on Jun. 26, 2019, which claims priority benefit of Japanese Patent Application No. JP 2018-148450 filed in the Japan Patent Office on Aug. 7, 2018. Each of the above-referenced applications is hereby incorporated herein by reference in its entirety.

TECHNICAL FIELD

The present technology relates to a technical field of a sound output device including a plurality of speaker units including a first speaker unit of a dynamic type.

BACKGROUND ART

There is a sound output device which is worn on a head or ears and used as headphones or earphones, and in which sound is output from speakers.

In the sound output device, it is preferable to secure an output state of sound of a wide band, and improvement of the sound quality of sound input to a user is attempted by outputting sound of a wide band.

In order to output such sound of a wide band, there is a sound output device in which a plurality of speaker units is arranged inside a housing (see, for example, Patent Document 1). By setting output bands of sound from the plurality of speaker units to different bands, it becomes possible to output sound of a wide band in the sound output device. The sound output device described in Patent Document 1 is provided with, for example, two speaker units of dynamic type.

CITATION LIST

Patent Document

Patent Document 1: Japanese Patent Application Laid-Open No. 2013-26746

SUMMARY OF THE INVENTION

Problems to be Solved by the Invention

Incidentally, in sound output devices such as headphones or earphones having a plurality of speaker units as described above, since sound output of different bands is performed from each of the plurality of speaker units, it is desirable that the sound output from each speaker unit reach an eardrum without being attenuated and thus the sound quality be improved.

In particular, if the attenuation of high-frequency sound is large, the sound quality is likely to deteriorate, and therefore it is important to suppress the attenuation of high-frequency sound for improving the sound quality.

Therefore, the present technology sound output device aims to improve the sound quality.

Solutions to Problems

Firstly, a sound output device according to the present technology includes a plurality of speaker units including a first speaker unit of a dynamic type, an arrangement case having an inner space formed as an arrangement space in which the plurality of speaker units is arranged, and a sound conduit protruding from the arrangement case and provided as a path for sound output from the plurality of speaker units, in which the first speaker unit has a highest sound output band among the plurality of speaker units, an axial direction of the sound conduit and an axial direction of the first speaker unit are oriented in the same direction, the speaker units except the first speaker unit are arranged around the first speaker unit or on an opposite side to the sound conduit with the first speaker unit therebetween, and a central axis of the first speaker unit is positioned further on an inner side than an inner peripheral surface of the sound conduit.

As a result of this, the first speaker unit having the highest sound output band is positioned further on the inner side than the inner peripheral surface of the sound conduit in the state of being oriented in the same direction as the axial direction of the sound conduit, and the speaker units except the first speaker unit are arranged around the first speaker unit or on the opposite side to the sound conduit with the first speaker unit therebetween.

Secondly, in the sound output device according described above, it is preferable that the central axis of the sound conduit and the central axis of the first speaker unit be set to coincide with each other.

As a result of this, the sound output from the first speaker unit becomes more likely to travel straight inside the sound conduit.

Thirdly, in the sound output device described above, it is preferable that the sound conduit be inserted into the external auditory canal, and part of the speaker unit be inserted into the intertragic notch in a state in which the sound conduit is inserted in the external auditory canal.

As a result of this, the sound output device is worn on the ear in a state in which part of a second speaker unit is inserted in the intertragic notch.

Fourthly, in the sound output device described above, it is preferable that the sound conduit be inserted into the external auditory canal, and part of the arrangement case be inserted into the cavum conchae in a state in which the sound conduit is inserted in the external auditory canal.

As a result of this, the sound output device is worn on the ear in a state in which part of the arrangement case is inserted in the cavum conchae.

Fifthly, in the sound output device described above, it is preferable that a second speaker unit and a third speaker unit be provided as the speaker units in addition to the first speaker unit, and one of the second speaker unit and the third speaker unit be arranged around the first speaker unit and the other be arranged on the opposite side to the sound conduit with the first speaker unit therebetween.

As a result of this, the second speaker unit and the third speaker unit are arranged at positions less likely to interfere with each other.

Sixthly, in the sound output device described above, it is preferable that a path of sound output from the first speaker unit serve as a first sound path, a path of sound output from the second speaker unit serve as a second sound path, a path of sound output from the third speaker unit serve as a third sound path, and part of the second sound path and part of the third sound path be positioned on opposite sides with the first sound path therebetween.

As a result of this, the sound output from the second speaker unit and the sound output from the third speaker unit pass through the sound conduit from different paths, and the sound output from the second speaker unit and the sound output from the third speaker unit are less likely to interfere with each other.

Seventhly, in the sound output device described above, it is preferable that a portion of the arrangement case continuous with the sound conduit be provided as an insertion portion to be inserted into a cavum conchae, the insertion portion be formed in a shape whose longitudinal direction is an up-down direction, and part of the second sound path and part of the third sound path be positioned separate from each other in the up-down direction inside the insertion portion.

As a result of this, part of the second sound path and part of the third sound path are positioned in the up-down direction inside the insertion portion.

Eighthly, in the sound output device described above, it is preferable that a merging space be formed between the sound conduit and the first speaker unit, and the first sound path, the second sound path, and the third sound path be merged in the merging space.

As a result of this, the sounds output from the first speaker unit, the second speaker unit, and the third speaker unit are merged before reaching the sound conduit, and the merged sound reaches the eardrum through the sound conduit.

Ninthly, in the sound output device described above, it is preferable that a balanced armature type be used as the second speaker unit, and a dynamic type be used as the third speaker unit.

As a result of this, both the first speaker unit and the third speaker unit are of a dynamic type.

Tenthly, in the sound output device described above, it is preferable that the axial direction of the first speaker unit and an axial direction of the third speaker unit be oriented in the same direction.

As a result of this, the first speaker unit and the third speaker unit are arranged in the arrangement space in the same direction.

Eleventhly, in the sound output device described above, it is preferable that the second speaker unit be arranged around the first speaker unit.

As a result of this, it becomes possible to employ a configuration in which an object blocking the sound output from the second speaker unit is not arranged in the second sound path.

Twelfthly, in the sound output device described above, it is preferable that an inner case arranged in the arrangement space be provided, and the first speaker unit, the second speaker unit, and the third speaker unit be attached to the inner case.

As a result of this, the three speaker units are arranged at respective predetermined positions in the arrangement space by arranging the inner case in the arrangement space in a state where the three speaker units are attached to the inner case.

Thirteenthly, in the sound output device described above, it is preferable that the first speaker unit and the third speaker unit be attached to the inside of the inner case, and the second speaker unit be attached to an outer surface of the inner case.

As a result of this, the inside and the outer surface of the inner case are each used as an attachment portion for the speaker units.

Fourteenthly, in the sound output device described above, it is preferable that the first speaker unit and the third speaker unit be attached to the inside of the inner case in a state of being inserted from opposite sides.

As a result of this, it becomes possible to reduce the amount of insertion of the first speaker unit and the third speaker unit into the inner case.

Effects of the Invention

According to the present technology, since a first speaker unit having the highest sound output band is positioned further on the inner side than the inner peripheral surface of a sound conduit in the state of being oriented in the same direction as the axial direction of the sound conduit, and speaker units except the first speaker unit are arranged around the first speaker unit or on the opposite side to the sound conduit with the first speaker unit therebetween, the sound output from the first speaker unit becomes more likely to be propagated in the axial direction inside the sound conduit, the attenuation of high-frequency sound is suppressed, and thus the sound quality can be improved.

Note that effects described in the present description are merely shown as examples and not limiting, and may also have different effects.

MODE FOR CARRYING OUT THE INVENTION

Hereinafter, a mode for implementing the present technology sound output device will be described with reference to the attached drawings.

An embodiment shown below is an application of the present technology sound output device to headphones. However, the scope of application of the present technology is not limited to headphones, and wide application to various other sound output devices such as earphones is possible.

Note that the sound output device shown below is provided with a speaker unit as an output unit of sound and a sound conduit as a path for sound output from the speaker unit, and in the following description, the front-back, left-right, and up-down directions will be shown with the axial direction of the sound conduit as the left-right direction.

However, the front-back, up-down, and left-right directions shown below are for convenience of explanation, and the implementation of the present technology is not limited to these directions.

<Structure of Ear>

Figure 1:
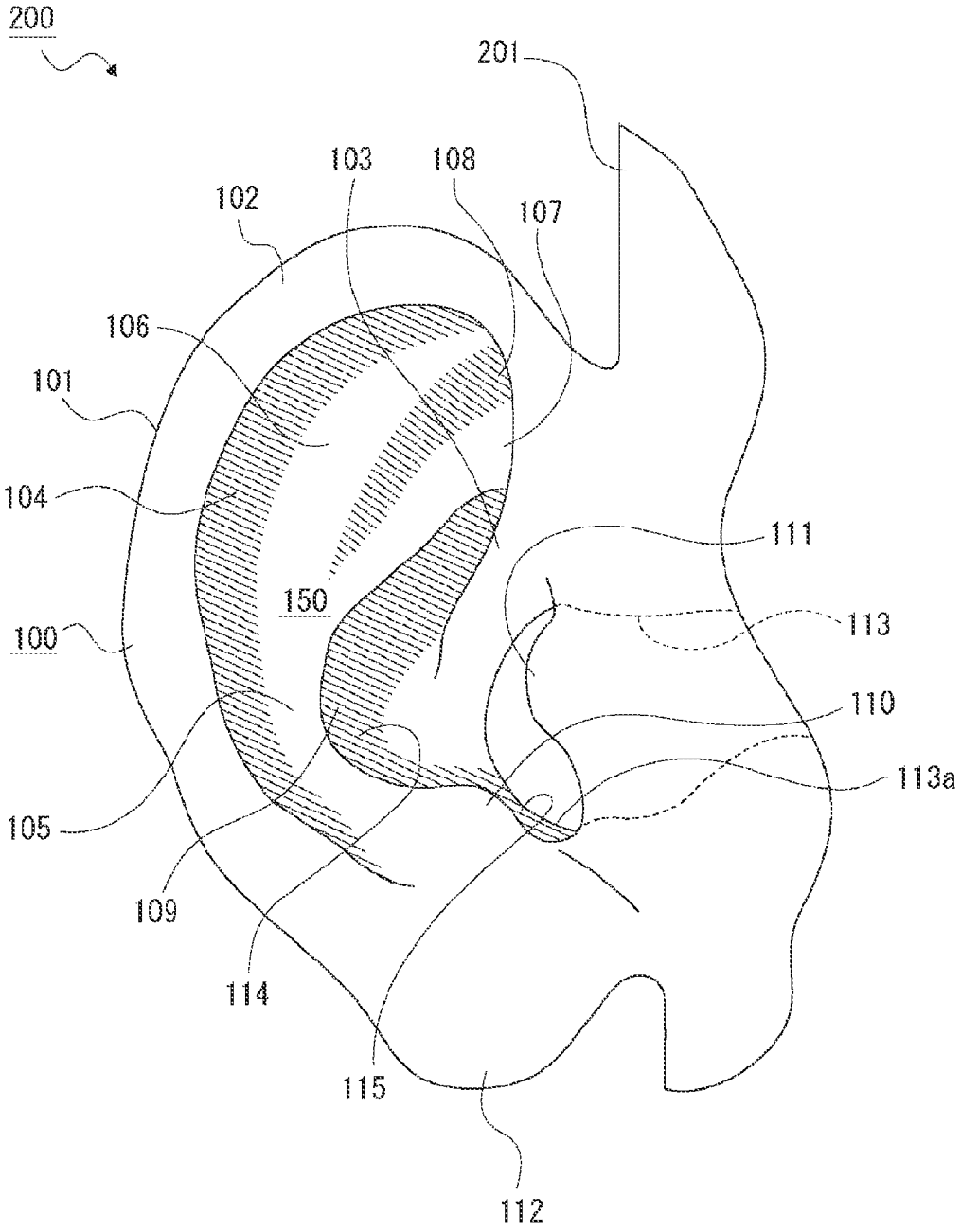
FIG. 1 illustrates an embodiment of a present technology sound output device together with FIGS. 2 to 10, and this diagram is a perspective view of an ear on which the sound output device is worn.
Figure 2:
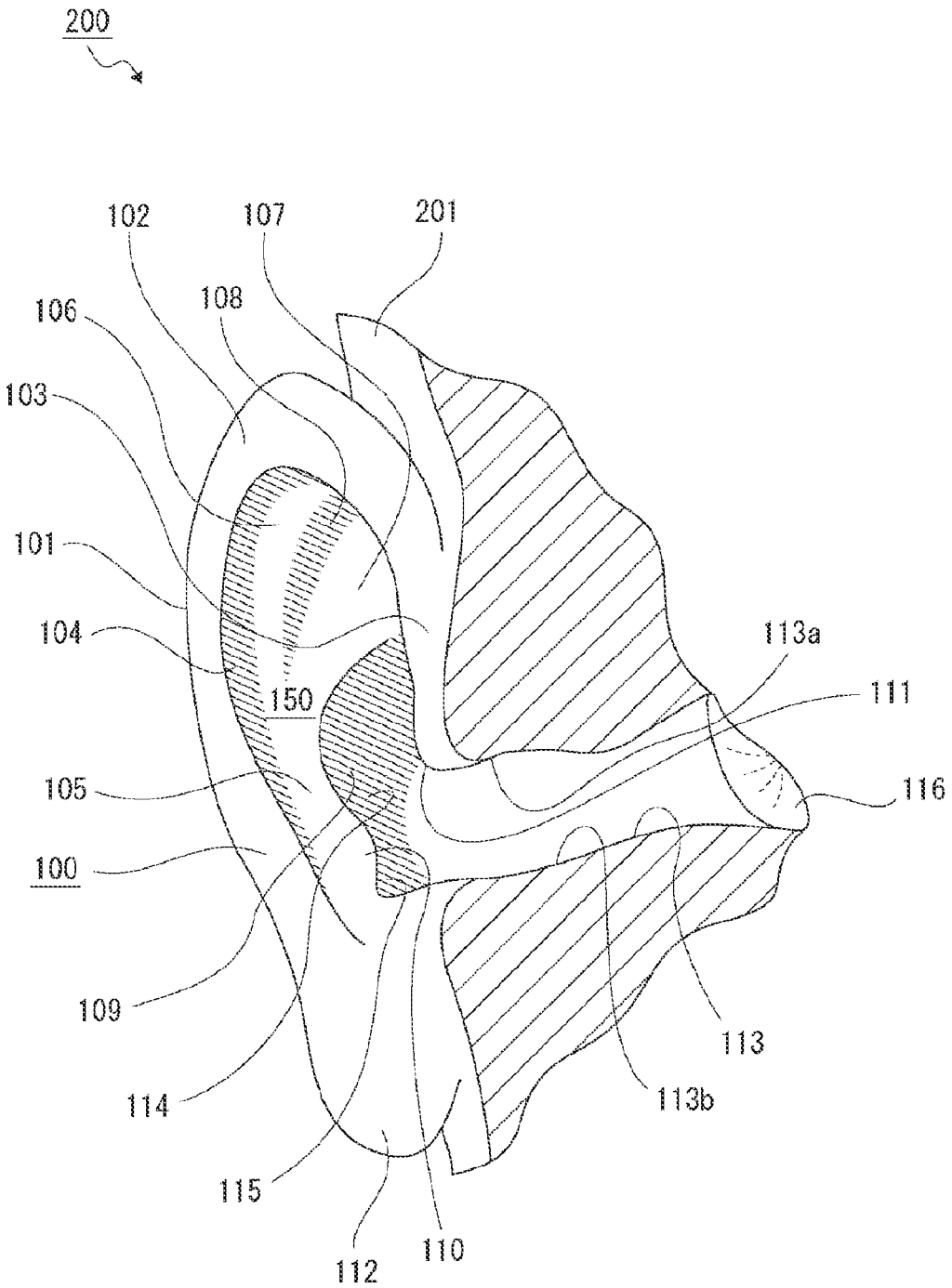
FIG. 2 is a perspective view of an ear in which part thereof is shown in cross-section.

First, a structure of an ear on which the sound output device is worn will be described (see FIGS. 1 and 2).

Ears 100 and 100 are considered to be a part of a head 200, and each include pinnas 101 and 101 and eardrums, semicircular canals, cochlea, and the like present inside the head 200. In the head 200, the inner portions of the pinnas 101 and 101 are respectively temporal portions 201 and 201, and the pinnas 101 and 101 each project to the left or to the right from the temporal portions 201 and 201.

The pinna 101 is overall formed in a shallow concave shape opened substantially to the front so as to have an inner space 150, and the outer peripheral portion thereof includes a portion called a helix 102 and a portion called a helical crus 103 continuous with the helix 102 and positioned in the vicinity of the temporal portion 201.

An inner portion of the helix 102 is referred to as a scaphoid fossa 104 having a concave shape, and approximately a lower half portion at the inner side of the scaphoid fossa 104 is referred to as an antihelix 105 having a convex shape. A bifurcated convex portion continuous with the antihelix 105 is present above the antihelix 105, and the outer and inner portions of the bifurcated portion are respectively referred to as an antihelix upper crus 106 and an antihelix lower crus 107. A portion between the antihelix upper crus 106 and the antihelix lower crus 107 is referred to as a triangular fossa 108 having a concave shape, and an inner portion of the antihelix 105 and the antihelix lower crus 107 is referred to as a cymba conchae 109 having a concave shape.

A portion continuous with the lower side of the antihelix 105 is a portion called an antitragus 110, which is slightly bulged toward the temporal portion 201 side. A portion on the temporal portion 201 side opposing the antitragus 110 is called a tragus 111 slightly bulging toward the antitragus 110, and a lower end portion continuous with the lower side of the helix 102 is called an earlobe 112.

An external auditory opening 113*a* that is an entrance of an external auditory canal 113 is present in a portion between the antitragus 110 and the tragus 111, and the external auditory canal 113 communicates with the eardrum, the semicircular canals, and the like. In the inner space 150 of the pinna 101, a space surrounded by the antihelix 105, the antihelix lower crus 107, and the helical crus 103, that is, a space on the front side of the cymba conchae 109 is called a cavum conchae 114 and communicates with the external auditory opening 113*a* of the external auditory canal 113. In the inner space 150, a space that is continuous with the lower side of the cavum conchae 114 and opened in a U shape is a space called an intertragic notch 115.

The external auditory canal 113 is a space surrounded by a wall surface 113*b*, and an eardrum 116 is present deep inside the external auditory canal 113.

The inner space 150 of the pinna 101 is a space including the cavum conchae 114, the intertragic notch 115, and the space near the external auditory opening 113*a* of the external auditory canal 113, and also including a space on the front side of the scaphoid fossa 104, the antihelix 105, the antihelix upper crus 106, the antihelix lower crus 107, the triangular fossa 108, the antitragus 110, and the tragus 111.

<Configuration of Sound Output Device>

Next, a configuration of a sound output device 1 will be described (see FIGS. 3 to 10).

For example, the sound output device 1 is used in a pair in which one is used for the left ear and the other is used for the right ear. However, the sound may be heard using one sound output device 1.

Figure 3:
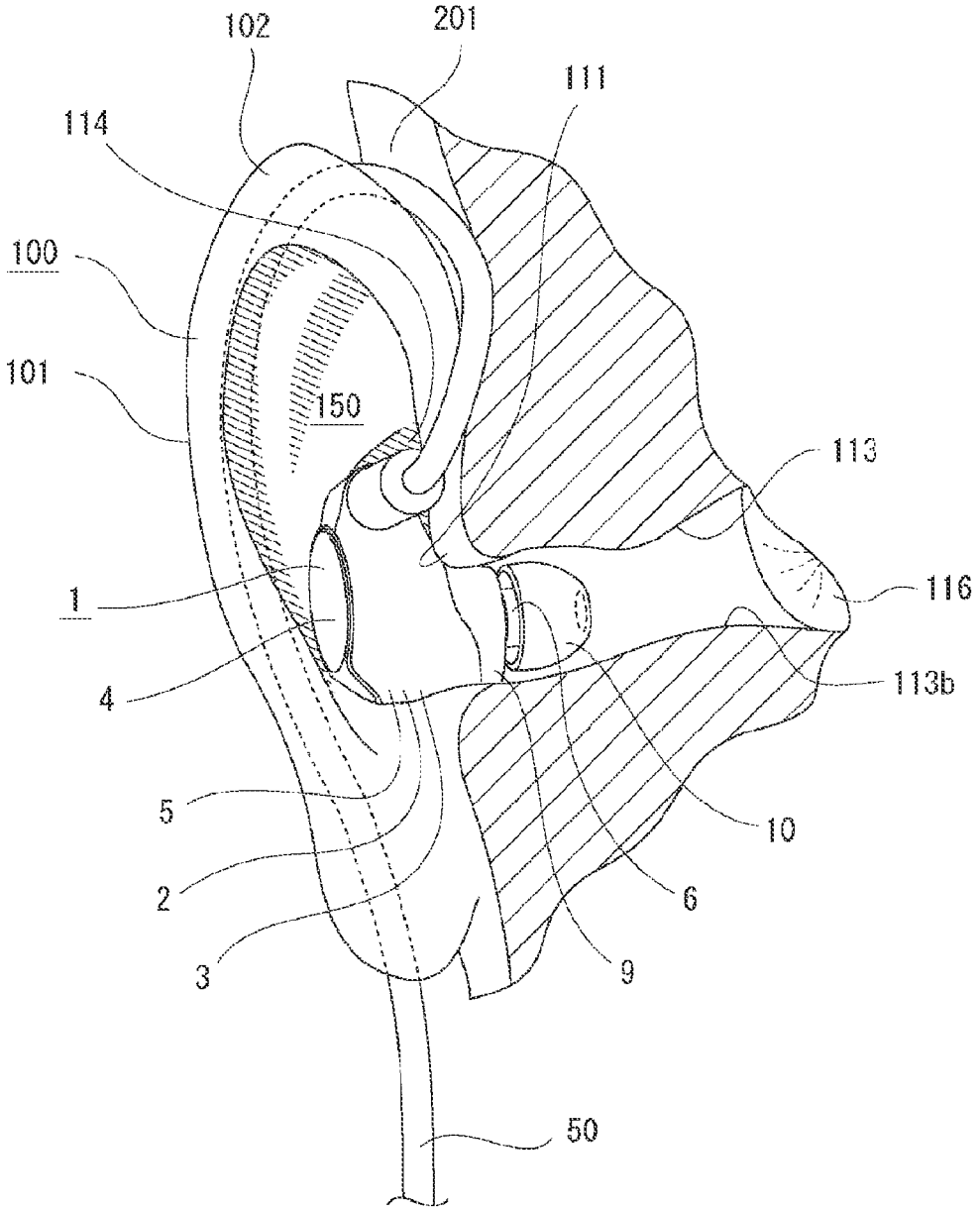
FIG. 3 is a perspective view illustrating a state in which the sound output device is worn on the ear.

A cable 50 is connected to an upper end portion of the sound output device 1 (see FIG. 3). For example, electric wires and signal lines that are not illustrated are arranged inside the cable 50, current is supplied to each part arranged inside the sound output device 1 via the electric wires to output sound, and signals are transmitted and received to and from other external devices and the like via the signal lines.

In the cable 50, an end portion connected to the sound output device 1 is provided as a connecting portion 51, and a portion near the connecting portion 51 is provided as an ear hook portion 52 curved in a substantially arc shape, and at least the connecting portion 51 and the ear hook portion 52 are configured to have a certain rigidity so as not to be deformed easily. In the cable 50, the ear hook portion 52 is engaged with, for example, an upper end side portion of the pinna 101.

Figure 4:
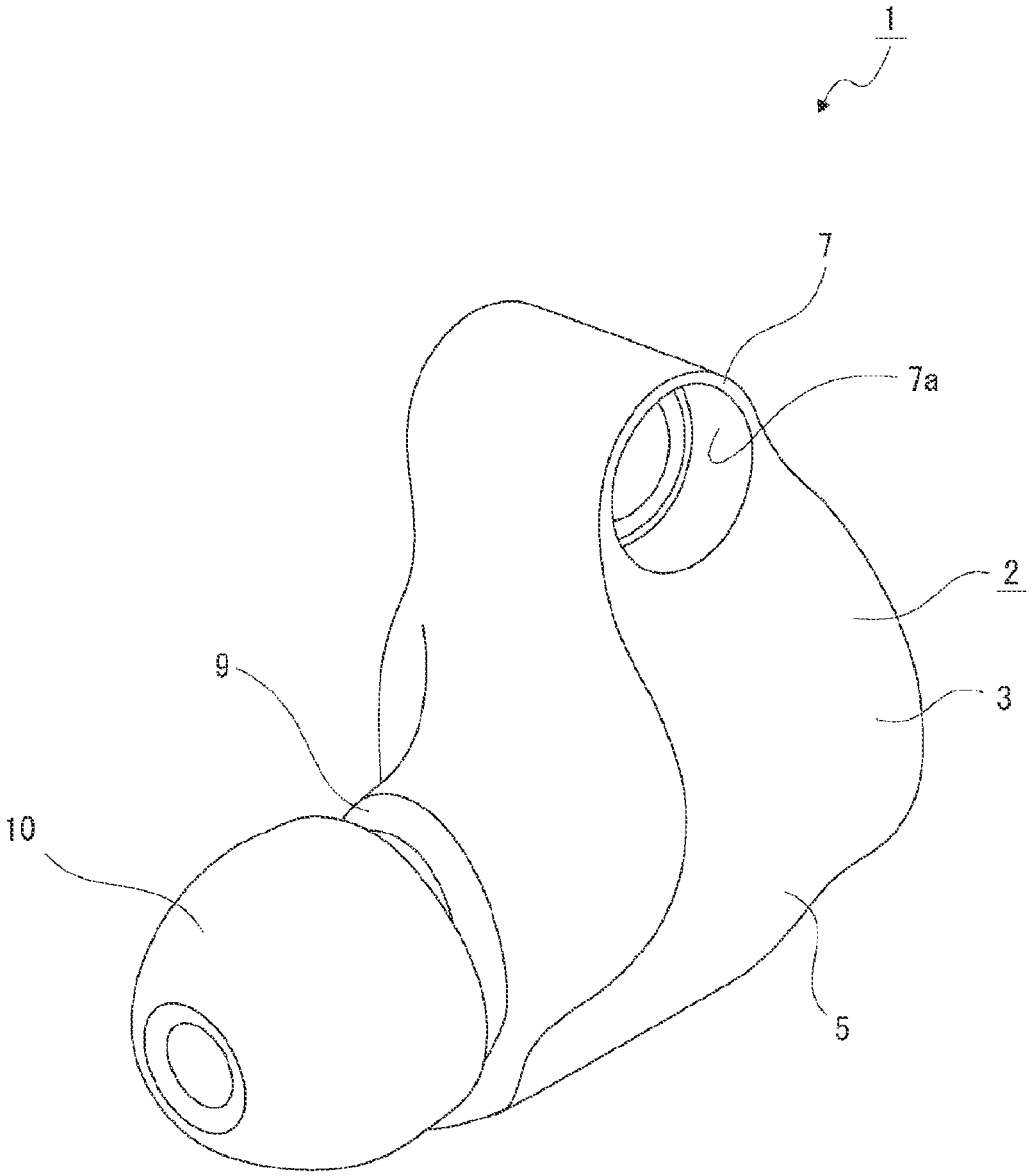
FIG. 4 is a perspective view of the sound output device.
Figure 5:
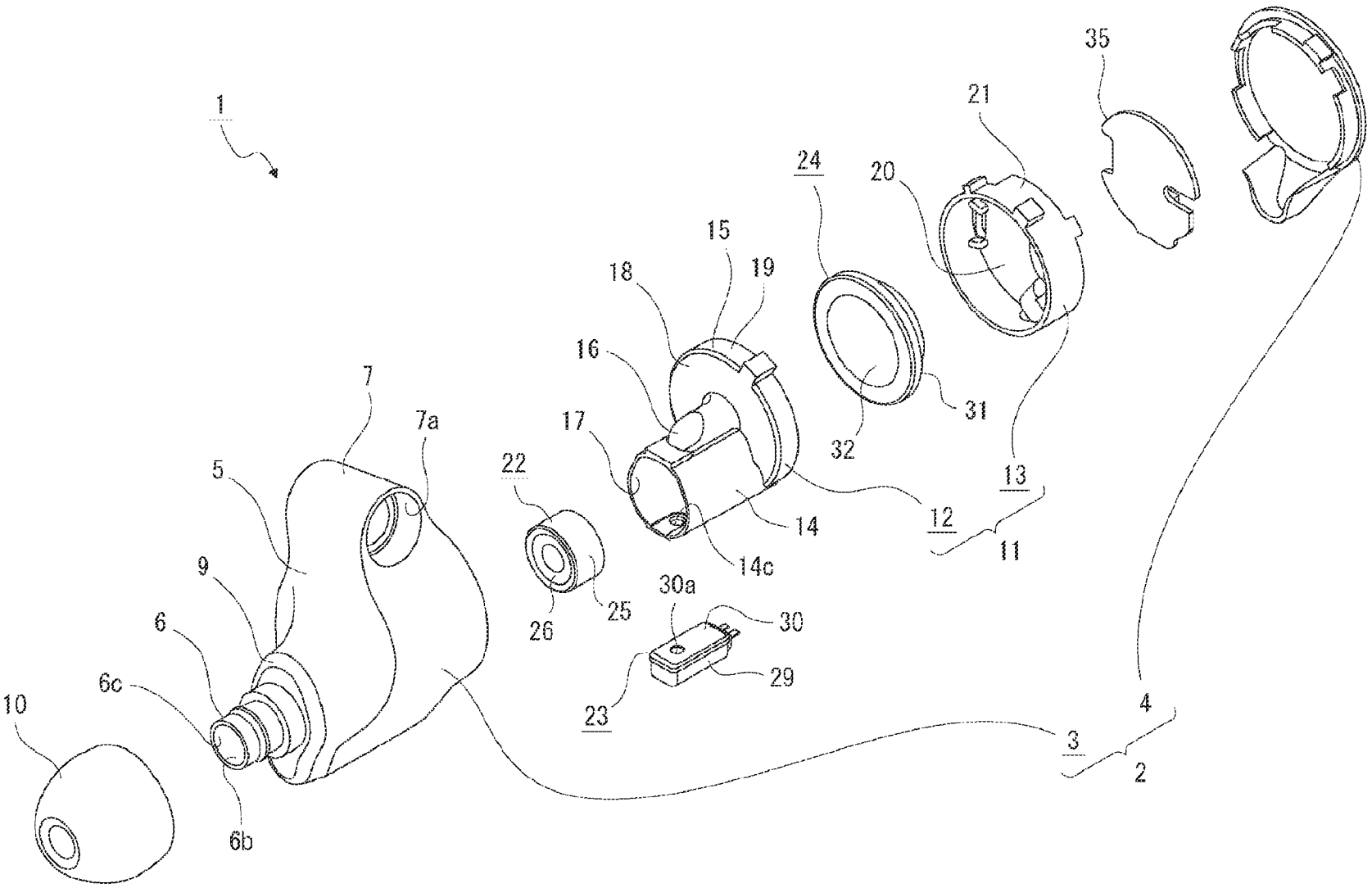
FIG. 5 is an exploded perspective view of the sound output device.
Figure 6:
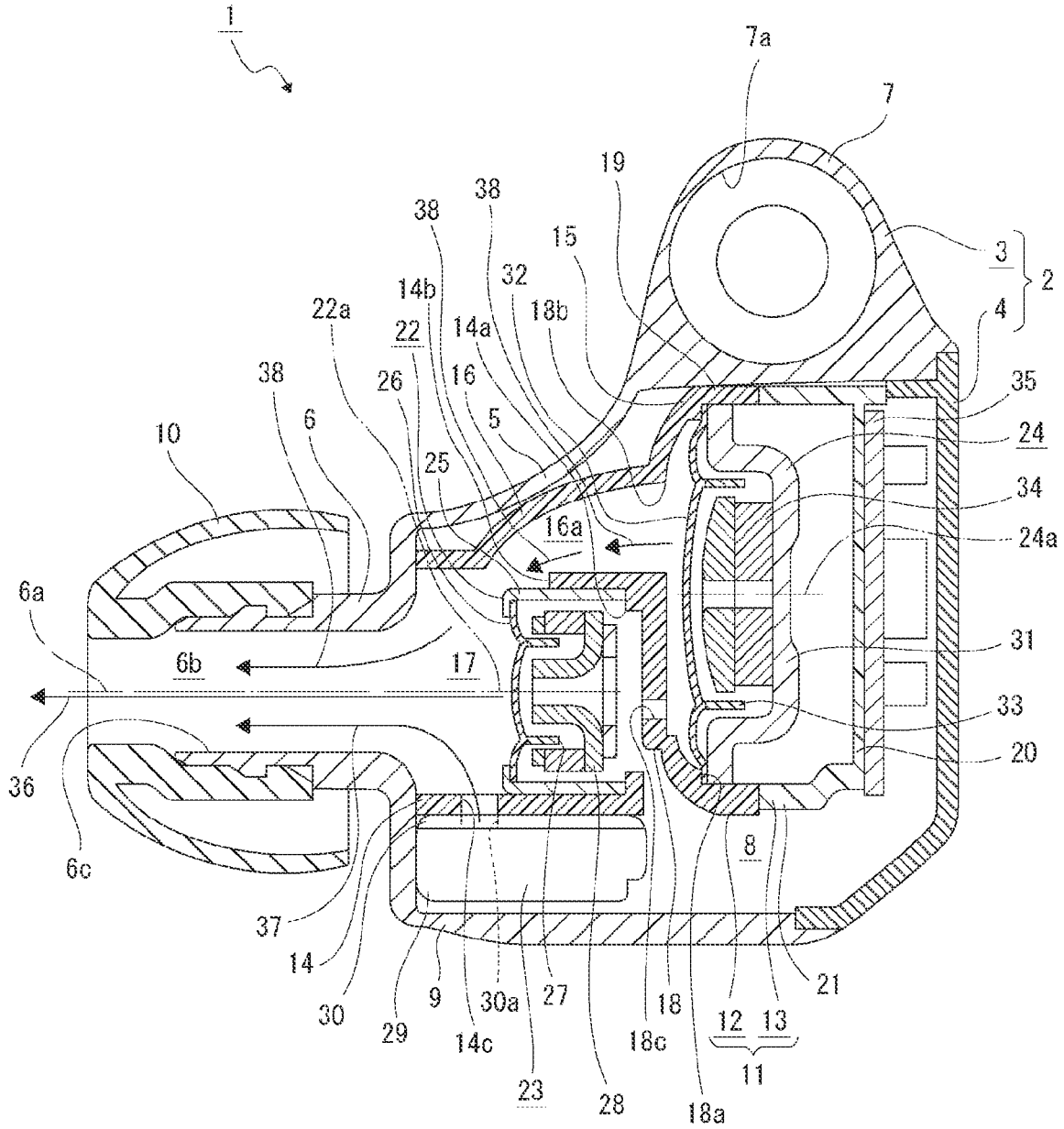
FIG. 6 is a cross-sectional view of the sound output device.
Figure 7:
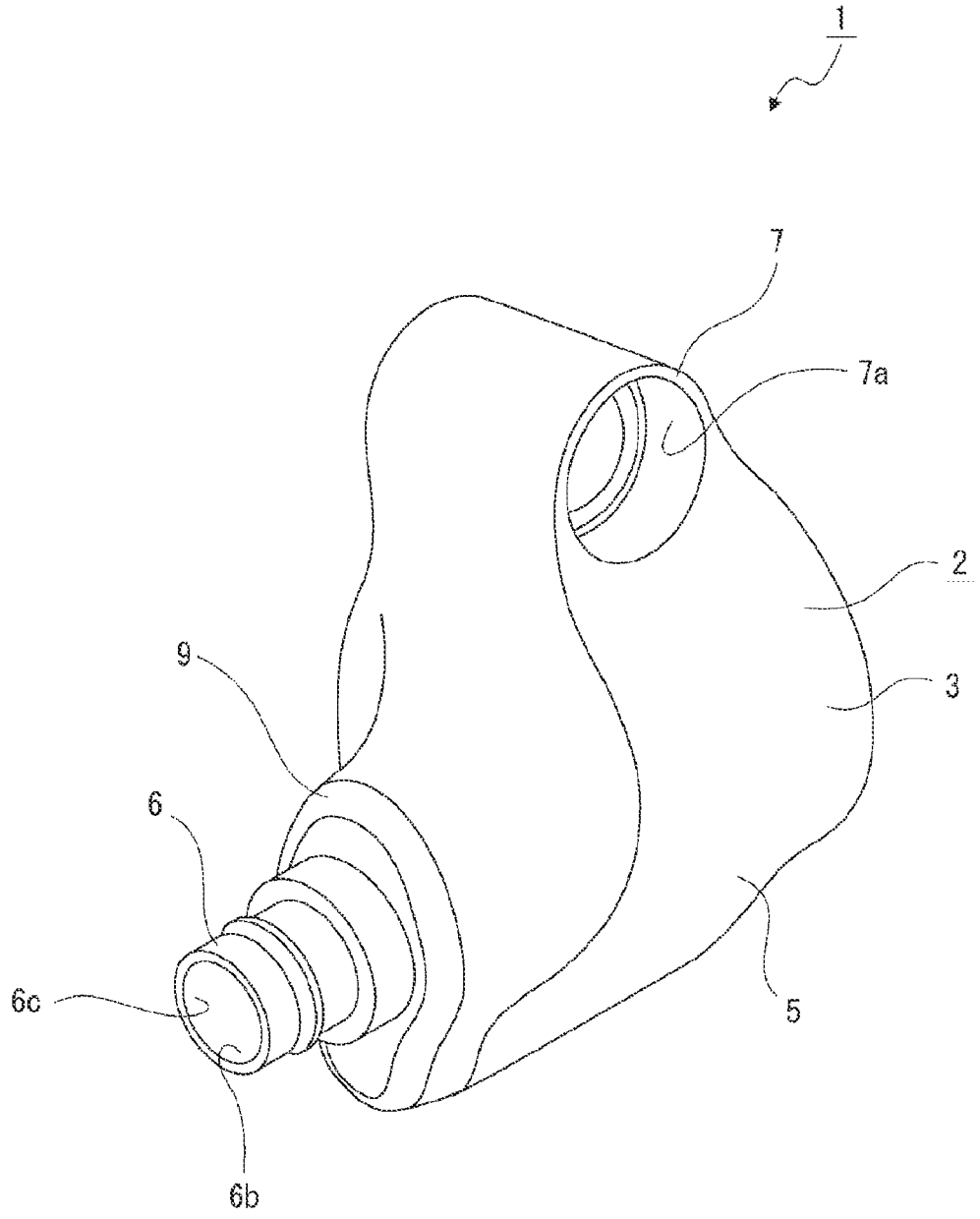
FIG. 7 is a perspective view of the sound output device illustrating a state in which an ear pad is removed.

The sound output device 1 is formed by arranging necessary parts inside and outside a housing 2, and the housing 2 is formed by connecting a case body 3 and a cover body 4 on the left side and the right side (see FIGS. 4 to 6).

The case body 3 is formed by integrally forming an arrangement case 5, a sound conduit 6, and a cable connecting portion 7. The sound conduit 6 projects laterally from the arrangement case 5, and the cable connecting portion 7 is provided continuously with an upper end portion of the arrangement case 5.

The arrangement case 5 is formed in a shape that is open to the side, and an inner space thereof is formed as an arrangement space 8. The arrangement case 5 is formed so that the outer shape of the end portion thereof on the sound conduit 6 side is smaller than the outer shape of the other portion thereof, and the end portion on the sound conduit 6 side is provided as an insertion portion 9. The insertion portion 9 is formed in a substantially elliptical shape that is elongated in the vertical direction when viewed from the side (see FIG. 7).

The sound conduit 6 is formed in a substantially cylindrical shape, and a central axis 6*a* thereof extends in the left-right direction, so that the axial direction is the left-right direction (see FIGS. 4 to 6). The sound conduit 6 protrudes from a substantially central portion of the insertion portion 9, and the inner space thereof is formed as a sound conduction space 6*b* that communicates with the arrangement space 8. An ear pad 10 is externally fitted to the sound conduit 6. The ear pad 10 includes a flexible material such as a rubber material.

An insertion hole 7*a* into which the cable 50 is inserted is formed in the cable connecting portion 7. A terminal and a conductive portion that are not illustrated are embedded in the cable connecting portion 7, and an unillustrated contact portion of the cable 50 is connected to the terminal in a state where the cable 50 is inserted in the insertion hole 7*a* and connected to the cable connecting portion 7. The cable 50 is connected to a control board, which is arranged in the arrangement space 8 and will be described later, via the terminal and the conductive portion.

The cover body 4 is coupled to the case body 3 and closes an opening of the case body 3 on the opposite side to the sound conduit 6.

An inner case 11 is arranged in the arrangement space 8 of the arrangement case 2 (see FIGS. 5 and 6). The inner case 11 includes a case body 12 to which each necessary part is attached and a case cover 13 coupled to the case body 12.

Figure 8:
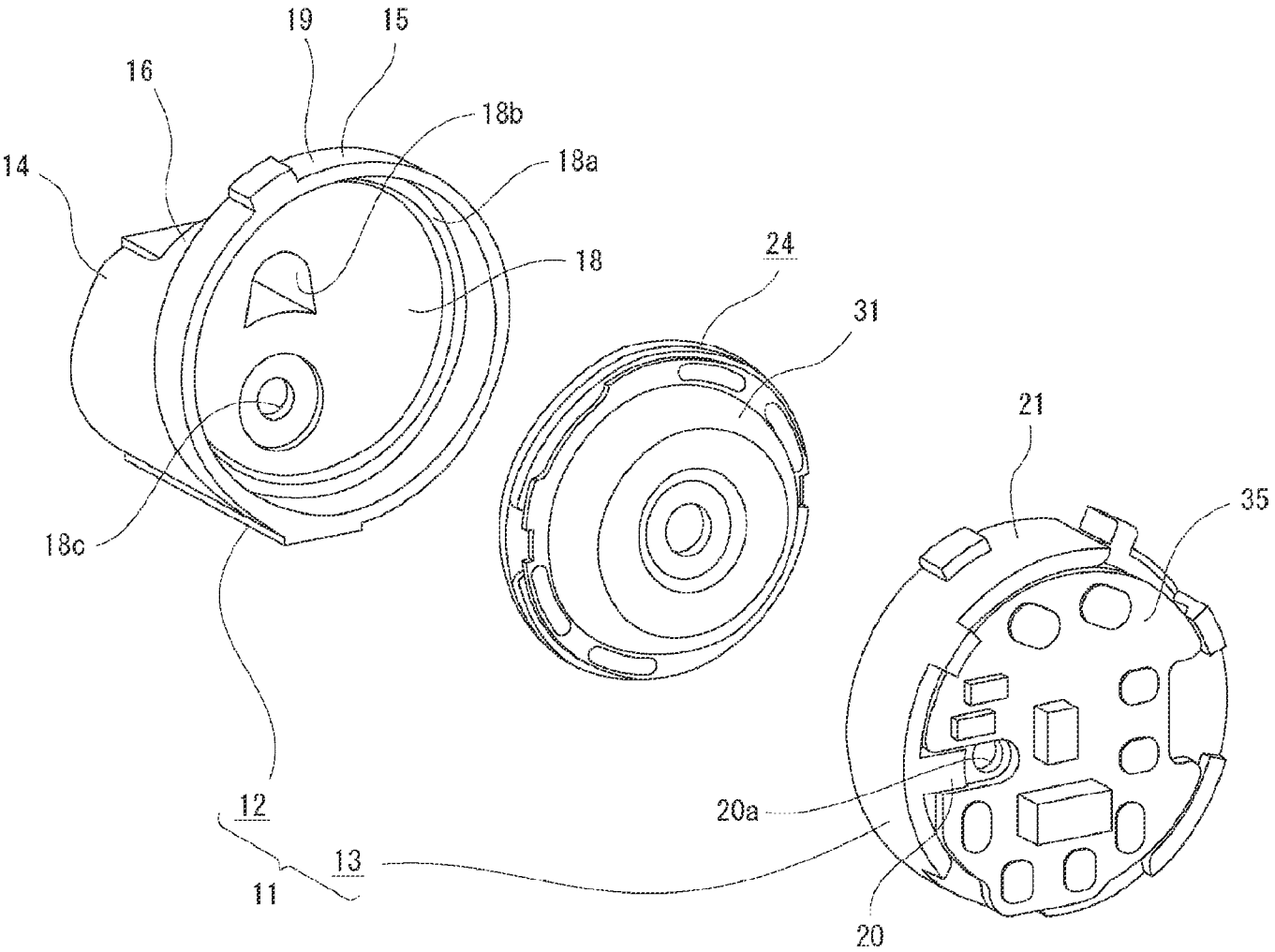
FIG. 8 is an exploded perspective view illustrating an inner case, a third speaker unit, and a control board.
Figure 9:
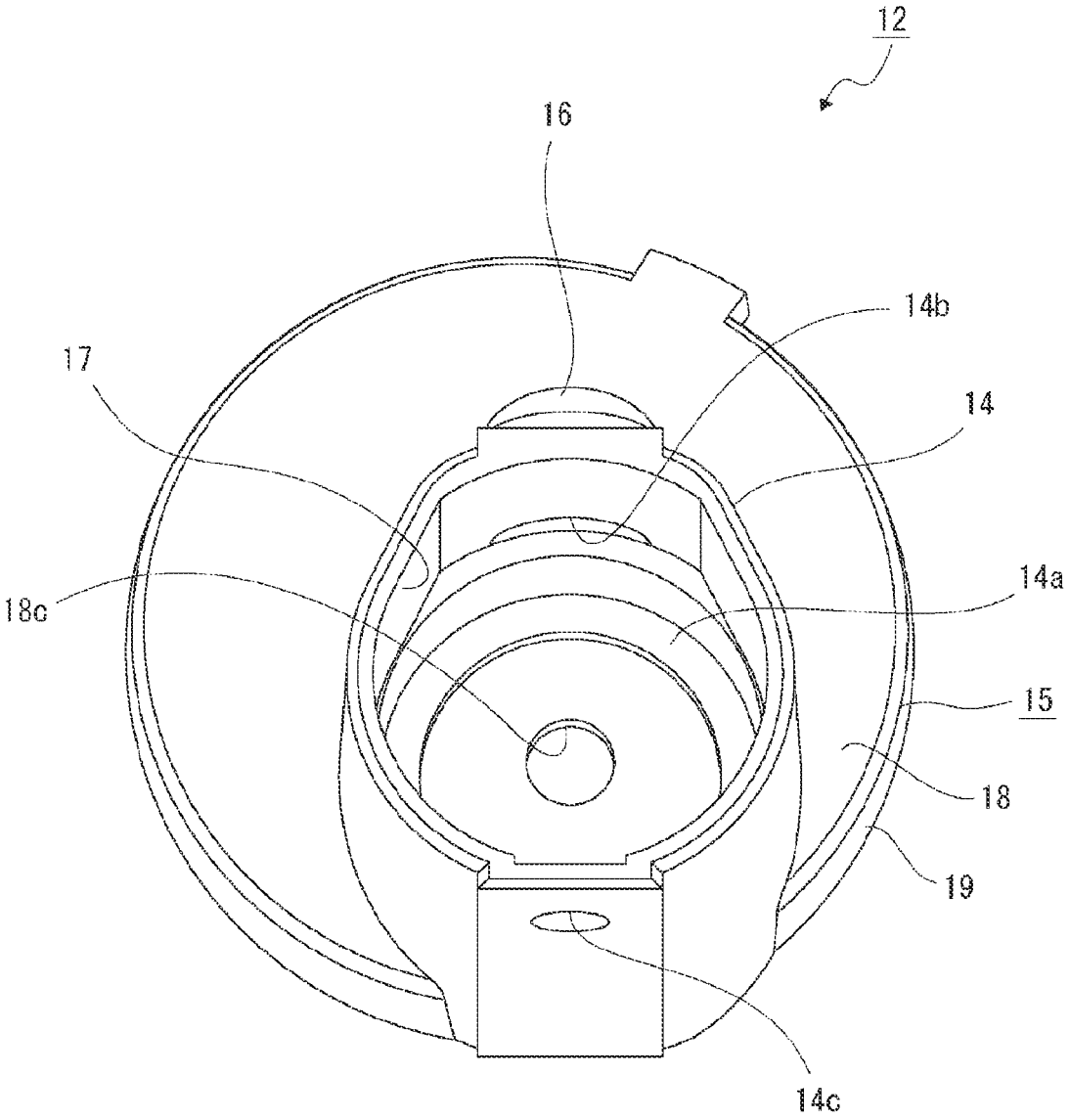
FIG. 9 is a perspective view illustrating a case body of the inner case.

The case body 12 includes a first attachment portion 14 formed in a substantially cylindrical shape, a second attachment portion 15 continuous with one end portion of the first attachment portion 14 in the axial direction, and a protruding portion 16 continuous with an upper end portion of the first attachment portion 14 (see FIGS. 6, 8, and 9).

The first attachment portion 14 is provided with a positioning fixing portion 14*a* having an annular shape at a position close to the outer circumference at an end portion thereof on the second attachment portion 15 side. In the first attachment portion 14, an upper passage hole 14*b* and a lower passage hole 14*c* penetrated in the up-down direction are respectively formed at the upper and lower end portions thereof. The inner space of an end portion of the first attachment portion 14 opposite to the second attachment portion 15 is formed as a merging space 17 in which sounds are merged. The upper passage hole 14*b* and the lower passage hole 14*c* communicate with the merging space 17, and the merging space 17 communicates with the sound conduction space 6*b*T of the sound conduit 6.

The second attachment portion 15 has a substantially disk-shaped base surface portion 18 facing in the left-right direction, and a peripheral surface portion 19 protruding from the outer peripheral portion of the base surface portion 18 to a side opposite to the first attachment portion 14.

A portion of the base surface portion 18 near the outer circumference protrudes to the side opposite to the first attachment portion 14, and this protruding portion is provided as a positioning fixing portion 18*a* having an annular shape. A sound introduction hole 18*b* and an air flow hole 18*c* are formed in the base surface portion 18 so as to be separate from each other in the up-down direction. The sound introduction hole 18*b* communicates with the inner space of the protruding portion 16.

The protruding portion 16 is formed in a shape that is displaced upward as the protruding portion 16 approaches the second attachment portion 15 in the left-right direction, and is continuous with the upper end portion of the first attachment portion 14 and a portion near the upper end of the base surface portion 18. The inner space of the protruding portion 16 is formed as a sound passage space 16*a*.

The case cover 13 has a flat plate-shaped cover surface portion 20 facing in the left-right direction and a circumferential coupling portion 21 protruding from the outer peripheral portion of the cover surface portion 20 toward one side in the left-right direction. The case cover 13 is coupled to the case body 12 by causing a distal end surface of the circumferential coupling portion 21 to abut a distal end surface of the peripheral surface portion 19. An insertion through hole 20*a* is formed in the cover surface portion 20.

A first speaker unit 22, a second speaker unit 23, and a third speaker unit 24 are attached to and held by the case body 12 of the inner case 11 (see FIGS. 4 and 6). The output band of the first speaker unit 22 is set to, for example, an ultra-high range outside an audible range, and the sound output band thereof is set to a higher range than that of the second speaker unit 23 and the third speaker unit 24. The output band of the second speaker unit 23 is set to a high range, and the output band of the third speaker unit 24 is set to a mid-to-low range.

The first speaker unit 22 is a speaker unit of a dynamic type, and includes a casing 25, a diaphragm 26, a coil bobbin 27, and a magnetic circuit unit 28. The casing 25 is formed in a substantially cylindrical shape. The outer peripheral portion of the diaphragm 26 is fixed to one end portion of the casing 25 in the axial direction. The coil bobbin 27 is attached to the diaphragm 26 and can be moved in the axial direction of the casing 25 (left-right direction). The magnetic circuit unit 28 includes a yoke, a magnet, and the like, and functions as a driving unit that moves the coil bobbin 27 in the axial direction of the casing 25.

When the coil bobbin 27 is moved in the axial direction of the casing 25 in the first speaker unit 22, the diaphragm 26 is vibrated integrally with the coil bobbin 27 to output sound.

The first speaker unit 22 is inserted into the first attachment portion 14 of the case body 12 until the first speaker unit 22 abuts the positioning fixing portion 14*a*, and is attached to the case body 12 by, for example, being glued to the positioning fixing portion 14*a*.

The second speaker unit 23 is a speaker unit of a balanced armature type, and includes an accommodating case 29, a covering lid 30, and an unillustrated sound output unit. The accommodating case 29 is formed in a box shape that is opened at least to the upper side. The covering lid 30 is attached to an upper end portion of the accommodating case 29, and closes the space inside the accommodating case 29. In the covering lid 30, a sound output hole 30*a* that is penetrated in the up-down direction is formed. The sound output unit is accommodated in the accommodating case 29, and includes a coil, a magnet, a diaphragm, and the like.

When the diaphragm of the sound output unit is vibrated in the second speaker unit 23, sound is output, and the output sound travels upward through the sound output hole 30*a* of the covering lid 30.

The second speaker unit 23 is attached to the case body 12 by gluing, for example, the covering lid 30 to the lower surface of the first attachment portion 14 in the case body 12. Therefore, the second speaker unit 23 is arranged around the first speaker unit 22. In the state where the second speaker unit 23 is attached to the case body 12, the sound output hole 30*a* of the covering lid 30 is positioned directly under the lower passage hole 14*c* of the first attachment portion 14.

The third speaker unit 24 is a speaker unit of a dynamic type, and includes a base body 31, a diaphragm 32, a coil bobbin 33, and a magnetic circuit unit 34. The base body 31 is formed in an annular shape. The base body 31 may be provided as a part of the magnetic circuit unit 34. The outer peripheral portion of the diaphragm 32 is fixed to the outer peripheral portion of the base body 31. The coil bobbin 33 is attached to the diaphragm 32 and can be moved in the axial direction of the base body 31 (left-right direction). The magnetic circuit unit 34 includes a yoke, a magnet, and the like, and functions as a driving unit that moves the coil bobbin 33 in the axial direction of the base body 31.

When the coil bobbin 33 is moved in the axial direction of the base body 31 in the third speaker unit 24, the diaphragm 32 is vibrated integrally with the coil bobbin 33 to output sound.

The third speaker unit 24 is inserted into the second attachment portion 15 of the case body 12 until the third speaker unit 24 abuts the positioning fixing portion 18*a* from a direction opposite to the insertion direction of the first speaker unit 22 into the first attachment portion 14, and is attached to the case body 12 by, for example, being glued to the positioning fixing portion 18*a*. In the state where the third speaker unit 24 is attached to the case body 12, the case cover 13 is coupled to the case body 12 as described above, and the case cover 13 closes the third speaker unit 24.

A control board 35 is attached to the outer surface of the case cover 13 at a position avoiding the insertion through hole 20*a* (see FIG. 8). The control board 35 is connected to the first speaker unit 22, the second speaker unit 23, and the third speaker unit 24 via a plurality of unillustrated connection lines or the like, and has a function of controlling the drive of the first speaker unit 22, the second speaker unit 23, and the third speaker unit 24. Each of the plurality of connection lines is inserted through the outside of the case body 12, the insertion through hole 20*a*, and the like, and is thus connected to the first speaker unit 22, the second speaker unit 23, and the third speaker unit 24.

The inner case 11 to which the first speaker unit 22, the second speaker unit 23, the third speaker unit 24, and the control board 35 are attached as described above is arranged in the arrangement space 8 and attached to the arrangement case 5 (see FIG. 6). In the state where the inner case 11 is attached to the arrangement case 5, the distal end surface of the first attachment portion 14 is caused to abut the inner surface of the arrangement case 5 on the sound conduit 6 side, and part of the second speaker unit 23 is positioned inside the insertion portion 9. Further, in the state where the inner case 11 is attached to the arrangement case 5, the merging space 17, which is a part of the inner space of the inner case 11, communicates with the sound conduction space 6*b*, which is the inner space of the sound conduit 6, and the third speaker unit 24 is arranged on the side opposite to the sound conduit 6 with the first speaker unit 22 therebetween. At this time, the central axis 6*a* of the sound conduit 6, a central axis 22*a* of the first speaker unit 22, and a central axis 24*a* of the third speaker unit 24 are oriented in the same direction, and the central axis 6*a* of the sound conduit 6 and the central axis 22*a* of the first speaker unit 22 are set to coincide with each other.

Figure 10:
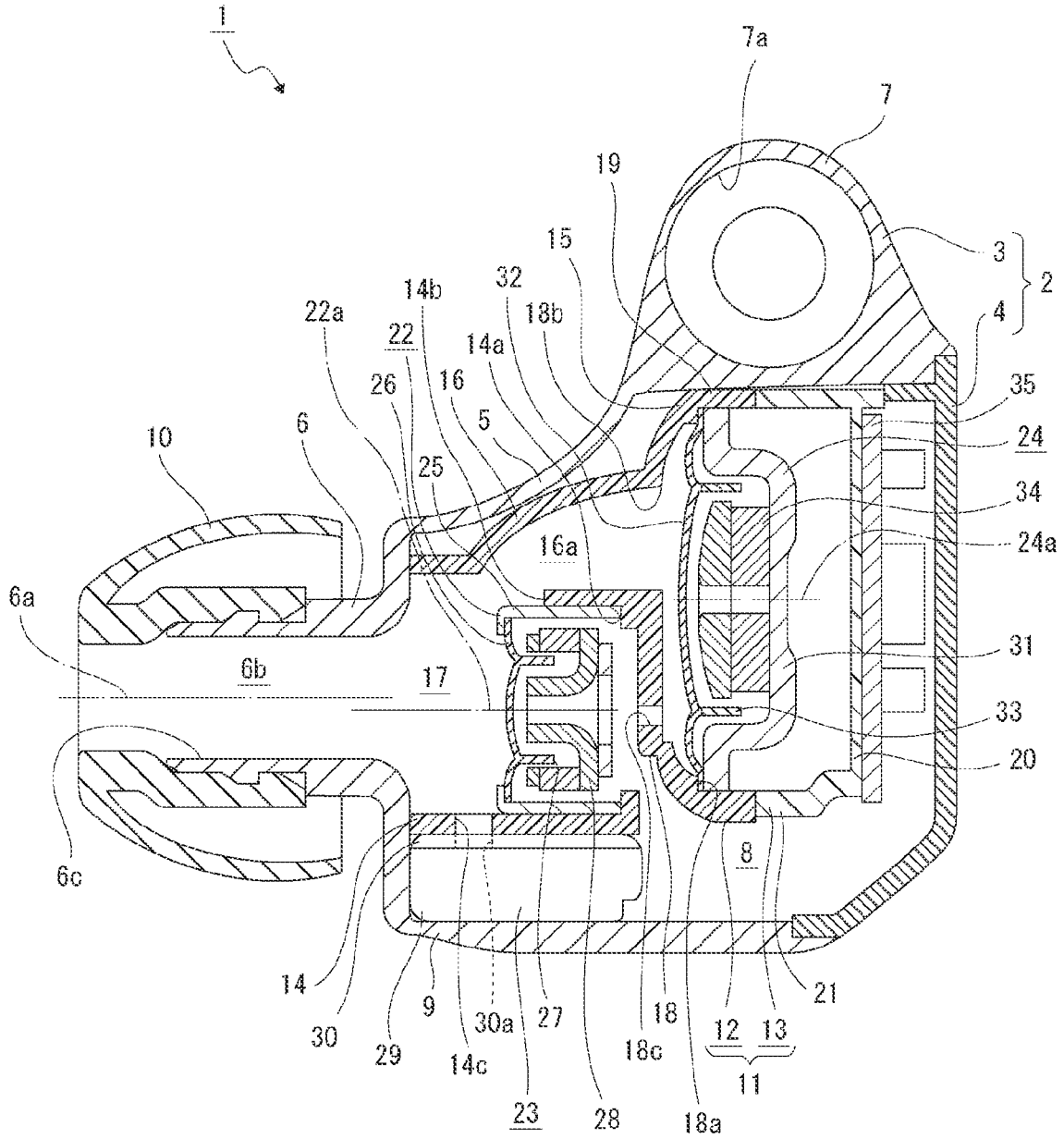
FIG. 10 is a cross-sectional view of the sound output device illustrating a state in which the central axis of a first speaker unit does not coincide with the central axis of a sound conduit and is positioned on the inner side of the inner peripheral surface of the sound conduit.

In addition, although an example in which the central axis 6*a* of the sound conduit 6 and the central axis 22*a* of the first speaker unit 22 are set to coincide with each other has been described above, for example, the central axis 22*a* of the first speaker unit 22 may be positioned on the inner side of the inner peripheral surface 6*c* of the sound conduit 6 instead of setting the central axis 6*a* of the sound conduit 6 and the central axis 22*a* of the first speaker unit 22 to coincide with each other (see FIG. 10).

As described above, in the sound output device 1, a balanced armature type is used as the second speaker unit 23, and a dynamic type is used as the third speaker unit 24, so that the first speaker unit 22 and the third speaker unit 24 are each of a dynamic type. Since a speaker unit of a balanced armature type is suitable for high-frequency sound output but the output band thereof is narrower than for the dynamic type, sound of a wide band can be output by using two speaker units of dynamic types and one speaker unit of a balanced armature type.

Further, since the axial direction of the first speaker unit 22 and the axial direction of the third speaker unit 24 are in the same direction, the first speaker unit 22 and the third speaker unit 24 are arranged in the same direction in the arrangement space 8, and the sound output device 1 can be miniaturized since the space efficiency of the arrangement space 8 is improved.

Further, the inner case 11 arranged in the arrangement space 8 is provided, and the first speaker unit 22, the second speaker unit 23, and the third speaker unit 24 are attached to the inner case 11.

Therefore, by arranging the inner case 11 in the arrangement space 8 in a state where the three speaker units are attached to the inner case 11, the three speaker units are arranged at respective predetermined positions in the arrangement space 8, and thus the three speaker units can be easily arranged in the predetermined positions.

Further, since the first speaker unit 22, the second speaker unit 23, and the third speaker unit 24 do not have to be separately arranged in the arrangement space 8 and respective attachment members for separately attaching the first speaker unit 22, the second speaker unit 23, and the third speaker unit 24 are not needed, the first speaker unit 22, the second speaker unit 23, and the third speaker unit 24 can be easily arranged in the arrangement space 8, and also the number of parts can be reduced.

Further, since the first speaker unit 22 and the third speaker unit 24 are attached to the inside of the inner case 11 and the second speaker unit 23 is attached to the outer surface of the inner case 11, the inside and the outer surface of the inner case 11 are each used as an attachment portion for a speaker unit, and the arrangement space 8 can be effectively utilized since the inner case 11 is miniaturized.

In addition, since the first speaker unit 22 and the third speaker unit 24 are attached to the inside of the inner case 11 in a state of being inserted from opposite sides, the amount of insertion of the first speaker unit 22 and the third speaker unit 24 into the inner case 11 can be reduced, and positioning and insertion of the first speaker unit 22 and the third speaker unit 24 with respect to the inner case 11 can be performed easily and with high accuracy.

<Wearing Sound Output Device on Ear>

The sound output device 1 configured as described above is worn on the ear 100 by inserting the sound conduit 6 of the housing 2 and the ear pad 10 attached to the sound conduit 6 into the external auditory canal 113 (see FIG. 3). At this time, in the sound output device 1, the insertion portion 9 of the arrangement case 5 is inserted into the cavum conchae 114 of the ear 100. Therefore, part of the second speaker unit 23 positioned inside the insertion portion 9 is inserted into the intertragic notch 115.

As described above, in the sound output device 1, since part of the second speaker unit 23 is inserted into the intertragic notch 115 in the state where the sound conduit 6 is inserted in the external auditory canal 113, the sound output device 1 is worn on the ear 100 in a state where part of the second speaker unit 23 is inserted in the intertragic notch 115, and good wearability of the sound output device 1 on the ear 100 can be secured while also the arrangement space of the speaker units in the arrangement space 8 is increased.

Further, since the insertion portion 9, which is a part of the arrangement case 5, is inserted into the cavum conchae 114 in the state where the sound conduit 6 is inserted in the external auditory canal 113, the sound output device 1 is worn on the ear 100 in the state where part of the arrangement case 5 is inserted in the cavum conchae 114, and good wearability of the sound output device 1 on the ear 100 can be secured.

Further, by providing the insertion portion 9 to be inserted into the cavum conchae 114 in the arrangement case 5, in a state in which the sound output device 1 is worn on the ear 100, the size of the arrangement case 5 can be increased by an amount corresponding thereto in a state in which the sound output device 1 does not protrude greatly from the ear 100, and the sound output device 1 can be miniaturized while a sufficient arrangement space for the first speaker unit 22, the second speaker unit 23, and the third speaker unit 24 in the arrangement space 8 is secured.

In particular, since the cavum conchae 114 is a recess portion having an elongated shape, smooth insertion of the insertion portion 9 into the cavum conchae 114 can be secured by forming the insertion portion 9 in an elongated shape.

<Path of Sound>

In the sound output device 1 configured as described above, the sound output from the first speaker unit 22 passes through the merging space 17 of the inner case 11, and reaches the eardrum 116 from the sound conduction space 6*b* of the sound conduit 6 via the external auditory canal 113. Therefore, the path from the merging space 17 to the sound conduction space 6*b* in the sound output device 1 serves as a first sound path 36, which is the path of the sound output from the first speaker unit 22 (see FIG. 6).

Further, the sound output from the second speaker unit 23 passes through the merging space 17 from the sound output hole 30*a* of the covering lid 30 and the lower passage hole 14*c* of the inner case 11, and reaches the eardrum 116 from the sound conduction space 6*b* of the sound conduit 6 via the external auditory canal 113. Therefore, the path from the sound output hole 30*a* to the sound conduction space 6*b* through the lower passage hole 14*c* and the merging space 17 in the sound output device 1 serves as a second sound path 37, which is the path of the sound output from the second speaker unit 23.

Further, the sound output from the third speaker unit 24 passes through the merging space 17 of the inner case 11 via the sound introduction hole 18*b*, the sound passage space 16*a*, and the upper passage hole 14*b* of the inner case 11, and reaches the eardrum 116 from the sound conduction space 6*b* of the sound conduit 6 via the external auditory canal 113. Therefore, the path from the sound introduction hole 18*b* to the sound conduction space 6*b* through the sound passage space 16*a*, the upper passage hole 14*b*, and the merging space 17 in the sound output device 1 serves as a third sound path 38, which is the path of the sound output from the third speaker unit 24.

As described above, the sound output from the second speaker unit 23 reaches the merging space 17 from the lower side of the first speaker unit 22, and the sound output from the third speaker unit 24 reaches the merging space 17 from the upper side of the first speaker unit 22. Therefore, part of the second sound path 37 and part of the third sound path 38 are positioned on opposite sides with the first sound path 36 therebetween.

Further, as described above, the respective sounds output from the first speaker unit 22, the second speaker unit 23, and the third speaker unit 24 are merged in the merging space 17, and reaches the eardrum 116 from the sound conduction space 6*b* via the external auditory canal 113.

Note that, when sound is output from each of the first speaker unit 22 and the third speaker unit 24, air is communicated through the air flow hole 18*c* of the inner case 11, and thus a good output state is secured for the sound output from each of the first speaker unit 22 and the third speaker unit 24.

SUMMARY

As described above, in the sound output device 1, a plurality of speaker units including the first speaker unit 22 of a dynamic type is provided, the first speaker unit 22 has the highest sound output band among the plurality of speaker units, the axial direction of the sound conduit 6 and the axial direction of the first speaker unit 22 are oriented in the same direction, the speaker units except the first speaker unit 22 are arranged around the first speaker unit 22 or on the opposite side to the sound conduit 6 with the first speaker unit 22 therebetween, and the central axis 22*a* of the first speaker unit 22 is positioned further on the inner side than the inner peripheral surface 6*c* of the sound conduit 6.

Therefore, the first speaker unit 22 having the highest sound output band is positioned further on the inner side than the inner peripheral surface 6*c* of the sound conduit 6 in the state of being oriented in the same direction as the axial direction of the sound conduit 6, and the speaker units except the first speaker unit 22 are arranged around the first speaker unit 22 or on the opposite side to the sound conduit 6 with the first speaker unit 22 therebetween. As a result of this, the sound output from the first speaker unit 22 can be easily propagated in the axial direction inside the sound conduit 6 and the attenuation of high-frequency sound is suppressed, and thus the sound quality in the sound output device 1 can be improved.

Further, as a result of the configuration in which the central axis 6*a* of the sound conduit 6 and the central axis 22*a* of the first speaker unit 22 coincide with each other, the sound output from the first speaker unit 22 is more likely to travel straight inside the sound conduit 6, and the propagation of sound wave is less likely to be hindered by the arrangement case 5 and the inner peripheral surface 6*c* of the sound conduit 6, and therefore a good transmission state of sound to the eardrum 116 can be secured.

Further, as the speaker units, the second speaker unit 23 and the third speaker unit 24 are provided in addition to the first speaker unit 22, the second speaker unit 23 is arranged around the first speaker unit 22, and the third speaker unit 24 is arranged on the opposite side to the sound conduit 6 with the first speaker unit 22 therebetween.

Therefore, since the second speaker unit 23 and the third speaker unit 24 are arranged at positions less likely to interfere with each other, the sound output device 1 can be miniaturized by effectively utilizing the arrangement space 8 of the arrangement case 5.

To be noted, on the contrary, a configuration in which the third speaker unit 24 is arranged around the first speaker unit 22, and the second speaker unit 23 is arranged on the opposite side to the sound conduit 6 with the first speaker unit 22 therebetween may be employed.

Further, since part of the second sound path 37 and part of the third sound path 38 are positioned on opposite sides with the first sound path 36 therebetween, the sound output from the second speaker unit 23 and the sound output from the third speaker unit 24 pass through the sound conduit 6 from different paths and the sound output from the second speaker unit 23 and the sound output from the third speaker unit 24 are less likely to interfere with each other, and thus the sound quality of the sound output device 1 can be improved.

Further, a portion of the arrangement case 5 continuous with the sound conduit 6 is provided as the insertion portion 9 to be inserted into the cavum conchae 114, the insertion portion 9 is formed in a shape whose longitudinal direction is the up-down direction, and part of the second sound path 37 and part of the third sound path 38 are positioned separate from each other in the up-down direction inside the insertion portion 9.

Therefore, since part of the second sound path 37 and part of the third sound path 38 are positioned separate from each other in the up-down direction inside the insertion portion 9 formed in accordance with the shape of the cavum conchae 114, the sound output device 1 can be miniaturized by effectively utilizing the space inside the insertion portion 9 while a good insertion state of the insertion portion 9 into the ear 100 is secured.

Furthermore, since the merging space 17 is formed between the sound conduit 6 and the first speaker unit 22 and the first sound path 36, the second sound path 37, and the third sound path 38 are merged in the merging space 17, the sounds output from the first speaker unit 22, the second speaker unit 23, and the third speaker unit 24 are merged before reaching the sound conduit 6, the merged sound reaches the eardrum 116 via the sound conduit 6, and the sound quality in the sound output device 1 can be improved.

In addition, since the second speaker unit 23 is arranged around the first speaker unit 22, it becomes possible to employ a configuration in which an object blocking the sound output from the second speaker unit 23 is not arranged in the second sound path 37 by positioning the sound output hole 30*a* of the second speaker unit 23 between the first speaker unit 22 and the sound conduit 6, and thus the sound quality of the sound output from the second speaker unit 23 can be improved.

<Others>

Although an example in which three speaker units of the first speaker unit 22, the second speaker unit 23, and the third speaker unit 24 are provided has been described above, the number of speaker units provided in the sound output device 1 is not limited as long as the first speaker unit 22 is included and the number is plural, and two speaker units or four or more speaker units may be provided.

Although an example in which the second speaker unit 23 is of a balanced armature type and the third speaker unit 24 is of a dynamic type has been described above, if the first speaker unit 22 is of a dynamic type, the other speaker units provided in the sound output device 1. may be of any type such as the balanced armature type, the dynamic type, or a type different from these as long as sound of a wide band can be output.

<Present Technology>

The present technology can be configured as follows.

(1)

A sound output device including:

a plurality of speaker units including a first speaker unit of a dynamic type;

an arrangement case having an inner space formed as an arrangement space in which the plurality of speaker units is arranged; and a sound conduit protruding from the arrangement case and provided as a path for sound output from the plurality of speaker units, in which the first speaker unit has a highest sound output band among the plurality of speaker units, an axial direction of the sound conduit and an axial direction of the first speaker unit are oriented in the same direction, the speaker units except the first speaker unit are arranged around the first speaker unit or on an opposite side to the sound conduit with the first speaker unit therebetween, and a central axis of the first speaker unit is positioned further on an inner side than an inner peripheral surface of the sound conduit.

(2)

The sound output device according to (1) described above, in which a central axis of the sound conduit and the central axis of the first speaker unit are set to coincide with each other.

(3)

The sound output device according to (1) or (2) described above, in which the sound conduit is inserted into an external auditory canal, and part of the speaker units is inserted into an intertragic notch in a state in which the sound conduit is inserted in the external auditory canal.

(4)

The sound output device according to any one of (1) to (3) described above, in which the sound conduit is inserted into the external auditory canal, and part of the arrangement case is inserted into a cavum conchae in a state in which the sound conduit is inserted in the external auditory canal.

(5)

The sound output device according to any one of (1) to (4) described above, in which a second speaker unit and a third speaker unit are provided as the speaker units in addition to the first speaker unit, and one of the second speaker unit and the third speaker unit is arranged around the first speaker unit and another is arranged on the opposite side to the sound conduit with the first speaker unit therebetween.

(6)

The sound output device according to (5) described above, in which a path of sound output from the first speaker unit serves as a first sound path, a path of sound output from the second speaker unit serves as a second sound path, a path of sound output from the third speaker unit serves as a third sound path, and part of the second sound path and part of the third sound path are positioned on opposite sides with the first sound path therebetween.

(7)

The sound output device according to (6) described above, in which a portion of the arrangement case continuous with the sound conduit is provided as an insertion portion to be inserted into a cavum conchae, the insertion portion is formed in a shape whose longitudinal direction is an up-down direction, and part of the second sound path and part of the third sound path are positioned separate from each other in the up-down direction inside the insertion portion.

(8)

The sound output device according to (6) or (7) described above, in which a merging space is formed between the sound conduit and the first speaker unit, and the first sound path, the second sound path, and the third sound path are merged in the merging space.

(9)

The sound output device according to any one of (5) to (8) described above, in which a balanced armature type is used as the second speaker unit, and a dynamic type is used as the third speaker unit.

(10)

The sound output device according to (9) described above, in which the axial direction of the first speaker unit and an axial direction of the third speaker unit are oriented in the same direction.

(11)

The sound output device according to (9) or (10) described above, in which the second speaker unit is arranged around the first speaker unit.

(12)

The sound output device according to any one of (5) to (11) described above, in which an inner case arranged in the arrangement space is provided, and the first speaker unit, the second speaker unit, and the third speaker unit are attached to the inner case.

(13)

The sound output device according to (12) described above, in which the first speaker unit and the third speaker unit are attached to an inside of the inner case, and the second speaker unit is attached to an outer surface of the inner case.

(14)

The sound output device according to (12) or (13) described above, in which the first speaker unit and the third speaker unit are attached to the inside of the inner case in a state of being inserted from opposite sides.

REFERENCE SIGNS LIST

100 Ear
113 External auditory canal
114 Cavum conchae
115 Intertragic notch
1 Sound output device
5 Arrangement case
6 Sound conduit
**6*a*** Sound conduction space
**6*b*** Central axis
**6*c*** Inner peripheral surface
8 Arrangement space
9 Insertion portion
11 Inner case
17 Merging space
22 First speaker unit
**22*a*** Central axis
23 Second speaker unit
24 Third speaker unit
**24*a*** Central axis
36 First sound path
37 Second sound path
38 Third sound path

The invention claimed is:

1. A sound output device, comprising:

a plurality of speaker units including a first speaker unit, a second speaker unit, and a third speaker unit, wherein the first speaker unit is of a dynamic type;

an arrangement case having an inner space as an arrangement space in which the plurality of speaker units is arranged; and a sound conduit protruding from the arrangement case and provided as a path for sound output from the plurality of speaker units, wherein the first speaker unit has a highest sound output band among the plurality of speaker units, an axial direction of the sound conduit and an axial direction of the first speaker unit are oriented in the same direction, the second speaker unit is around the first speaker unit, the third speaker unit is on an opposite side to the sound conduit with the first speaker unit therebetween, and a central axis of the first speaker unit is closer to a central axis of the sound conduit than an inner peripheral surface of the sound conduit.

2. The sound output device according to claim 1, wherein the central axis of the sound conduit coincides with the central axis of the first speaker unit.

3. The sound output device according to claim 1, wherein the sound conduit is insertable into an external auditory canal, and a part of the second speaker unit is inserted into an intertragic notch in a state in which the sound conduit is inserted in the external auditory canal.

4. The sound output device according to claim 1, wherein the sound conduit is insertable into an external auditory canal, and a part of the arrangement case is inserted into a cavum conchae in a state in which the sound conduit is inserted in the external auditory canal.

5. The sound output device according to claim 1, wherein a path of sound output from the first speaker unit serves as a first sound path, a path of sound output from the second speaker unit serves as a second sound path, a path of sound output from the third speaker unit serves as a third sound path, a part of the second sound path is opposite to a part of the third sound path, and the first sound path is between the part of the second sound path and the part of the third sound path.

6. The sound output device according to claim 5, wherein a portion of the arrangement case continuous with the sound conduit corresponds to an insertion portion to be inserted into a cavum conchae, the insertion portion is in a shape whose longitudinal direction is an up-down direction, and the part of the second sound path and the part of the third sound path are positioned separate from each other in the up-down direction inside the insertion portion.

7. The sound output device according to claim 5, wherein a merging space is between the sound conduit and the first speaker unit, and the first sound path, the second sound path, and the third sound path are merged in the merging space.

8. The sound output device according to claim 1, wherein the second speaker unit is of a balanced armature type, and the third speaker unit is of the dynamic type.

9. The sound output device according to claim 8, wherein the axial direction of the first speaker unit and an axial direction of the third speaker unit are oriented in the same direction.

10. The sound output device according to claim 1, further comprising an inner case in the arrangement space, wherein the first speaker unit, the second speaker unit, and the third speaker unit are attached to the inner case.

11. The sound output device according to claim 10, wherein the first speaker unit and the third speaker unit are attached to an inside of the inner case, and the second speaker unit is attached to an outer surface of the inner case.

12. The sound output device according to claim 10, wherein the first speaker unit is attached to an inside of the inner case in a state of being inserted from a first side of the inner case, the third speaker unit is attached to the inside of the inner case in a state of being inserted from a second side of the inner case, and the first side is opposite to the second side.

* * * * *